United States Patent [19]

Bibber

[11] Patent Number: 4,988,396

[45] Date of Patent: Jan. 29, 1991

[54] CORROSION RESISTANT ALUMINUM COATING COMPOSITION

[75] Inventor: John W. Bibber, Batavia, Ill.

[73] Assignee: Sanchem, Inc., Chicago, Ill.

[21] Appl. No.: 343,997

[22] Filed: Apr. 26, 1989

[51] Int. Cl.[5] ..... C23C 22/56

[52] U.S. Cl. ..... 148/269; 148/273; 148/275

[58] Field of Search ..... 148/269, 272, 273, 275; 106/14–21

[56] References Cited

U.S. PATENT DOCUMENTS

| | | | |
|---|---|---|---|
| 2,127,206 | 8/1938 | Curtin . | |
| 3,516,877 | 6/1970 | Papafingos et al. . | |
| 4,504,324 | 3/1989 | Forumo | 148/275 |
| 4,711,667 | 12/1987 | Bibber | 148/273 |

FOREIGN PATENT DOCUMENTS

| | | | |
|---|---|---|---|
| 0122879 | 9/1980 | Japan | 148/275 |

*Primary Examiner*—Sam Silverberg

*Attorney, Agent, or Firm*—Laff, Whitesel, Conte & Saret

[57] ABSTRACT

This invention provides an aluminum alloy conversion coating composition and a process for protecting aluminum alloys, especially the alloys having greater than 1.0% Cu with a conversion coating. The coating is placed on the aluminum alloy in a multi-step process. In a first step the alloy is treated with a composition having as essential ingredients aluminum nitrate and an alkali metal nitrate, in a second step the nitrate treated alloy is treated with an alkali metal permanganate composition and in the final step the alloy is treated with an alkali metal silicate composition.

The aluminum conversion coatings of this invention are provided without the need for using toxic chromium compounds.

5 Claims, No Drawings

CORROSION RESISTANT ALUMINUM COATING COMPOSITION

The present invention relates to a corrosion resistant coating for aluminum alloys having greater than 1% Cu., aluminum alloy articles coated with an intermediate protective coating, and the process for coating aluminum alloys with a protective corrosion resistant coating.

BACKGROUND OF THE INVENTION

Generally, aluminum alloys are protected by forming thereon an intermediate corrosion resistant conversion coating and then painting over the corrosion resistant coating. Therefore, the corrosion resistant coating must be intimately bonded to the aluminum surface and also provide the required adhesion with the desired final aluminum coating-i.e., paint.

One of the widely used processes for protecting aluminum alloys with a corrosion resistant intermediate coating is to coat the surface of the aluminum alloys with a protective conversion coating of an acid based hexavalent chromium composition or other heavy metal such as zirconium and titanium.

All of these processes leave a very thin film of a heavy metal salt on the aluminum alloy which prevents the metal from becoming dark when subjected to boiling water for periods of time up to 30 minutes. These coatings also provide a suitable base for the application and retention of other coatings, such as paint, to the aluminum alloy surfaces.

The hexavalent chromium provides a corrosion resistant coating which can withstand a salt fog bath for more than 168 hours. The coated aluminum alloy is placed in a salt fog at 95° F. according to ASTM method B-117 for at least 168 hours and then removed. This requirement is necessary for may application. Further, the hexavalent chromium composition provides an intermediate coating which is receptive to the application and retention of other coatings, such as paints, to the aluminum alloy surfaces.

The excellent features of the hexavalent chromium composition, have made these compositions used extensively for the corrosion resistant protection of aluminum alloys and as an intermediate corrosion resistant coating.

However, the hexavalent chromium compositions have a serious side effect. Chromium is highly toxic and the spent chromium compositions provide an ecological problem. Many people in the industry are attempting to eliminate this ecologically damaging waste problem and it is very costly.

Corrosion resistant permanganate compositions have been suggested, as noted in our U.S. Pat. Nos. 4,711,667 and 4,755,224.

SUMMARY OF THE INVENTION

Our invention eliminates some of the problems of the hexavalent chromium and other heavy metal compositions by providing a corrosion resistant conversion coating composition which contains no chromium or other similar toxic materials.

Also, for aluminum alloys having at least 1.0% Cu, we provide a corrosion resistant conversion coating which can withstand a salt fog at 95° F. according to ASTM Method B-117 for at least 168 hours.

The aluminum alloy having a Cu content of greater than 1.0%, i.e. 2024 aluminum alloy, is first degreased, cleaned, deoxidized and then oxidized. The oxidized alloy is then treated with a nitrate composition, preferably lithium nitrate and aluminum nitrate. This coating is rinsed with water and then treated with a permanganate solution. The alloy is again rinsed and given a final treatment with an alkali metal silicate and a final rinse.

In the above process the preferred aluminum alloy to be protected are those in the 200 series-i.e., 2024 aluminum alloy having an average composition of 4.4% Cu, 0.6% Mn, 1.52% Mg and 93.5% Al.

The outer oxide layer is removed preferably with nitric acid. The permanganate coating solution contains: 0.2 to 6.3% by weight alkali metal permanganate, preferably 0.2 to 0.5% by weight with the alkali metal being potassium.

The aluminum nitrate-lithium nitrate solution contains:

0.2 to 2.0% by weight aluminum nitrate and 0.2 to 2.0% by weight lithium nitrate, preferably 0.5% to 1.5% by weight of each.

The alkali metal permanganate compositions may be applied in any acceptable manner (i.e., immersion, spraying, misting or spreading by an appropriate applicator).

The aluminum alloy surface is normally immersed in our aqueous alkali metal permanganate solution. The temperature of the solution is between room temperature and the boiling point of the composition. The preferred temperature is between 60° and 180° F., with the most preferred between 100° and 180° F. However, as the temperature is raised, less immersion time is necessary to form the desired coating.

The alkali metal as referred to herein is selected from potassium, sodium or lithium.

The preferred alkali metal permanganate is potassium or sodium permanganate.

The concentration of the permanganate, to provide 168 hours of salt fog protection for the aluminum alloys is of a sufficient amount to provide at least 700 ppm of manganese in the coating solution with the practical maximum being the saturation point of the permanganate. When potassium permanganate is used, a concentration of 0.2% by weight is about 700 ppm manganese. At room temperature, a saturated $KMnO_4$ solution is 6.3% by weight; 32° F. is 2.8% by weight and at 212° F. is 28% by weight. The sodium permanganate is infinitely soluble and, therefore, has no practical upper limit.

Other compounds may be added to the permanganate solutions if desired, providing the compounds do not interfere with the desired corrosion resistant protection of the aluminum alloy surfaces.

The cleaning compounds for the aluminum alloy surfaces are sodium hydroxide, alkaline solutions of sodium nitrate, hydrofluoric acid, sulfuric acid, nitric acid, sodium carbonate, borax, and a commercial non-ionic surfactant polyoxyethylene or polyoxypropylene derivatives of organic acids, alcohols, alkylphenols or amines, a commercial non-ionic surfactant which has been used is a polyoxyethylene derivative of organic acids such as "Triton X-100" sold by Rohm and Haas Corp.

It is also recommended that neither the cleaning composition nor the alkali metal permanganate composition contain a fatty acid, or any compound which would interfere with adhesion or formation of a protective conversion coating on the aluminum alloy surface.

In the following Example aluminum alloy 2024 is coated with non-chromium corrosion protective coating compositions. Aluminum alloy 2024 is usually used for or in combination with heavy equipment. This type of alloy generally needs an intermediate protective coating for long periods of time.

EXAMPLE

An aluminum alloy panel of "2024" alloy (has on average a composition of: 4.4% Cu, 0.6% Mn, 1.5% Mg and 93.5% Al) was degreased with mineral spirits and cleaned to a break-free surface with a commercial non-ionic surfactant such as Triton X-100 from Rohm and Haas Corp. After rinsing with water, the panel was deoxidized in a 10% nitric acid solution of 85° C. for 20 minutes. After rinsing with deionized water, the panel was placed in deionized water at 195°-212° F. for five minutes to form a layer of boehmite (Al0. . . 0H) on the metal surface. The oxidized alloy was further treated in a 1.0% aluminum nitrate, 1.0% lithium nitrate solution at 195°-212° F. for five minutes. This was followed by a rinse in deionized water. The rinsed nitrate treated alloy was then treated in 0.3% potassium permanganate ($KMnO_4$) (PH=5.0-8.0) solution at 140° F. for five minutes. The permanganate treated panel was then rinsed and given a final seal coating by being immersed in a potassium silicate solution (0.83% $K_2O$ and 2.1% $SiO_2$) at 195°-212° F. for one minute. The panel was removed from the silicate solution and rinsed with deionized water. The panel was then placed in a salt-fog at 95° F. according to ASTM Standard B-117. After 168 hours of exposure, the panel showed only minor pitting.

Our example shows use of protective compositions that do not have toxicity of chromates and are therefore more environmentally effective.

I claim:

1. An aluminum alloy having greater than 1.0% Cu and having thereon a protective coating formed by treating the alloy first with a lithium nitrate and aluminum nitrate solution, second with potassium permanganate solution and third with an alkali metal silicate composition.

2. An aluminum alloy having greater than 1.0 Cu and having thereon a protective coating applied in at least three steps with a first step coating composition containing lithium nitrate and aluminum nitrate, a second step coating composition containing potassium permanganate and a third step being a coating composition containing alkali metal silicate.

3. A process of protecting aluminum alloys having more than 1.0% Cu with an intermediate corrosion resistant coating comprising multi-coating the alloy with at least one coating containing aluminum ions and nitrate ions, a second coating containing an alkali metal permanganate and a third coating containing an alkali metal silicate.

4. The process of claim 3 wherein the aluminum alloy is first coated with a solution containing 0.2-2.0% by weight aluminum nitrate and 0.2-2.0% by weight lithium nitrate, then coated with a solution containing 0.2 to 6.3% by weight alkali metal permanganate; and finally with a solution of alkali metal silicate.

5. The process of claim 4 wherein prior to coating the aluminum alloy, the alloy is cleaned, degreased, deoxidized and then oxidized, and in between each coating, the alloy is rinsed with deionized water.

* * * * *